United States Patent [19]

Suzuki

[11] Patent Number: 4,744,498

[45] Date of Patent: May 17, 1988

[54] BUTTON HOLDER/DIE ASSEMBLY IN A DEVICE FOR ATTACHING BUTTONS TO SHEET MEMBERS

[75] Inventor: Takeshi Suzuki, Toyama, Japan

[73] Assignee: Yoshida Kogyo K. K., Tokyo, Japan

[21] Appl. No.: 896,065

[22] Filed: Aug. 13, 1986

[30] Foreign Application Priority Data

Aug. 13, 1985 [JP] Japan ..... 60-124179[U]
Aug. 13, 1985 [JP] Japan ..... 60-124180[U]

[51] Int. Cl.[4] ..... B25C 7/00

[52] U.S. Cl. ..... 227/140; 227/156; 29/453

[58] Field of Search ..... 227/31, 32, 15, 16, 227/61, 62, 149, 155, 156, 154, 140; 29/453, 235, 229

[56] References Cited

U.S. PATENT DOCUMENTS

| | | | |
|---|---|---|---|
| 495,753 | 4/1893 | Platt | 227/140 |
| 916,026 | 3/1909 | Sasseman | 227/149 |
| 2,786,203 | 3/1957 | Treciokas | 227/140 |
| 2,997,716 | 8/1961 | Huelster et al. | 227/140 |

*Primary Examiner*—E. R. Kazenske
*Assistant Examiner*—James L. Wolfe
*Attorney, Agent, or Firm*—Hill, Van Santen, Steadman & Simpson

[57] ABSTRACT

A button holder/die assembly in a device for attaching a button to a sheet member, includes a die having a frustoconical portion tapered toward a button support, and a smaller-diameter neck disposed between the button support and the frustoconical portion. The button holder/die assembly also includes a tubular button holder of a resilient material movably fitted over the die for holding a button member. The tubular button holder has a cylindrical wall having one end for supporting the button member and on the opposite end a plurality of radially inwardly extending normally engaging the neck. The tubular button holder can be moved axially onto the frustoconical portion in response to a force applied axially to said one end, while the lips are sliding up the frustoconical portion away from the neck against their resiliency, and can be moved axially away from the frustoconical portion in response to removal of the force, while the lips are sliding down the frustoconical portion onto the neck under their resiliency.

5 Claims, 3 Drawing Sheets

BUTTON HOLDER/DIE ASSEMBLY IN A DEVICE FOR ATTACHING BUTTONS TO SHEET MEMBERS

BACKGROUND OF THE INVENTION

1. Field of the Invention

The present invention relates to a button holder/die assembly in a device for attaching buttons such as snap buttons, hook buttons, ornamental buttons, or the like to sheet members such as fabric pieces, leather pieces, synthetic resin sheets, or the like.

2. Description of the Prior Art

Japanese Utility Model Publication No. 45-7847 published Apr. 15, 1970 discloses a lower die assembly used in a device for attaching snap buttons. The lower die assembly includes a lower die normally urged upwardly by a spring disposed therearound, the lower die having a presser. When a snap button is to be attached to a fabric piece, an upper die is lowered to press snap button members on the fabric piece against the presser, which is pushed downwardly to move the lower die downwardly against the resiliency of the spring. After the snap button members are attached as a completed snap button to the fabric piece, the upper die is lifted, while at the same time the lower die is allowed to move upwardly under the resiliency of the spring. The disclosed lower die assembly is however complex in construction as it is made up of many parts, and cannot be employed to attach smaller snap buttons to fabric pieces.

An upper holder/die for attaching hook buttons is shown in Japanese Laid-Open Utility Model Publication No. 57-39930 published Mar. 3, 1982. The upper holder/die has a presser on a lower end thereof, which is surrounded by a resilient holder of rubber, for example. A hook button member to be attached to a fabric member in combination with a companion hook button member is resiliently supported by the resilient holder. For attaching a hook button to the fabric member, the upper die is moved downwardly toward a lower die, and pressed against the same to fasten the hook button members by staking to the fabric member. However, when the upper and lower dies are brought together, the lower end of the resilient holder tends to be elastically deformed inwardly and pinched between the hook button member and the fabric member, with the result that the hook button cannot be attached to the fabric member in intimate contact therewith.

SUMMARY OF THE INVENTION

It is an object of the present invention to provide a button holder/die assembly of a simple construction capable of attaching buttons of relatively small size to sheet members.

Another object of the present invention is to provide a button holder/die assembly of a simple construction capable of attaching buttons to sheet members in intimate contact therewith.

According to the present invention, there is provided a button holder/die assembly in a device for attaching a button to a sheet member, including a die having a button support, a frustoconical portion tapered toward the button support, and a neck disposed between the button support and the frustoconical poriton, the neck being smaller in diameter than the button support and smoothly blending into the frustoconical portion. The button holder/die assembly also includes a tubular button holder of a resilient material movably fitted over the die for holding a button member, the tubular button holder having a cylindrical wall having means on one end thereof for supporting the button member and on the opposite end a plurality of radially inwardly extending lips normally engaging the neck. The tubular button holder can be moved axially onto the frustoconical portion in response to a force applied axially to the one end, while the lips are sliding up the frustoconical portion away from the neck against their resiliency, and can be moved axially away from the frustoconical portion in response to removal of the force, while the lips are sliding down the frustoconical portion onto the neck under their resiliency.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
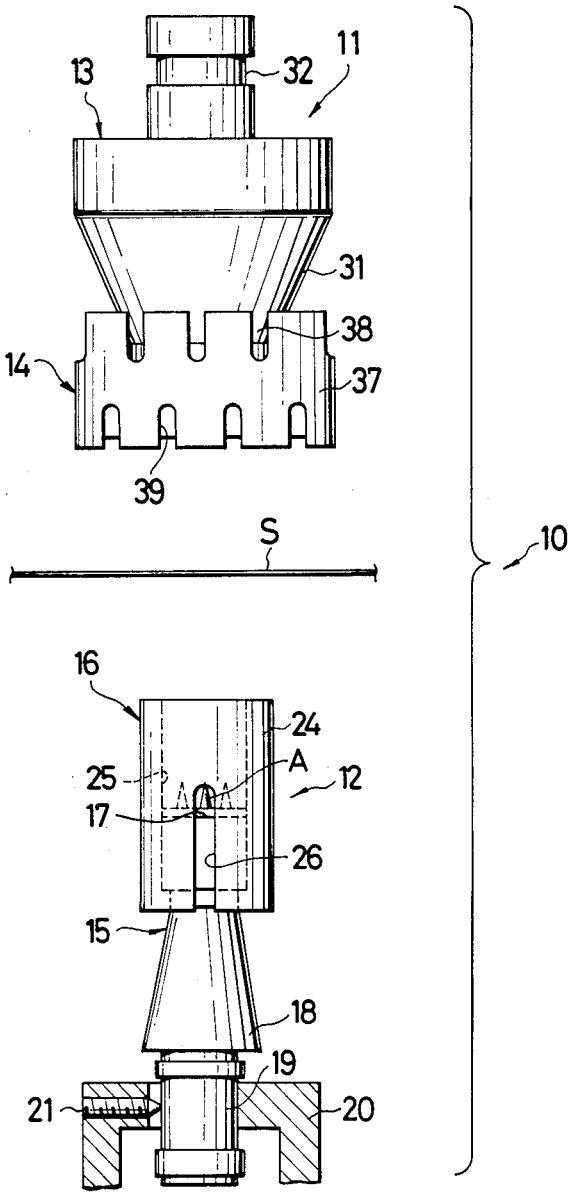
FIG. 1 is a front elevational view of a device for attaching a button to a sheet material.

As shown in FIG. 1, a device for attaching buttons such as snap buttons, hook buttons, ornamental buttons, or the like to sheet members such as fabric pieces, leather pieces, synthetic resin sheets, or the like, is generally indicated by the reference numeral 10, and essentially comprises an upper button holder/die assembly 11 and a lower button holder/die assembly 12.

The upper button holder/die assembly 11 comprises an upper die 13 and a button holder 14 movably fitted over the upper die 13. The lower button holder/die assembly 12 comprises a lower die 15 and a button holder 16 movably fitted over the lower die 15.

Figure 2:
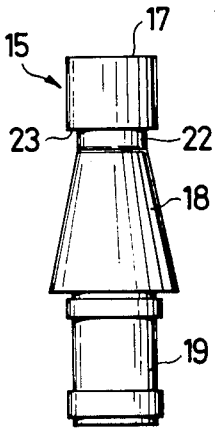
FIG. 2 is a front elevational view of a lower die.
Figure 2A:
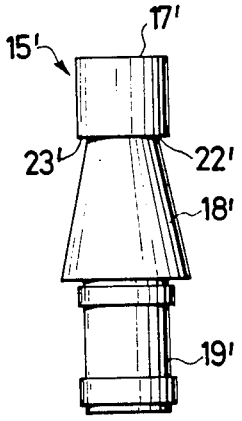
FIG. 2A is a view similar to FIG. 2, but showing a modified lower die.

As illustrated in FIG. 2, the lower die 15 is generally of a cylindrical form made of synthetic resin or metal. The lower die 15 has an upper support portion 17 for supporting a pronged button member A (FIG. 1), a central frustoconical portion 18 disposed below the upper support portion 17 and has its circumferential surface tapered upwardly toward the upper support portion 17 or progressively spreading radially outwardly in the downward direction, and a lower attachment portion 19 positioned beneath the central frustoconical portion 18. As shown in FIG. 1, the lower attachment portion 19 is mounted on a base 20 and secured thereto by a setscrew 21. The lower die 15 has a neck 22 of a smaller diameter extending between the upper support portion 17 and the central frustoconical portion 18. The neck 22 is adjoined by a lower radial shoulder 23 of the upper support portion 17 which is larger in diameter than the neck 22, but smoothly blends into the upper end of the frustoconical portion 18. Alternatively, the smaller-diameter end of the frustoconical portion 18' is joined directly with the lower radial shoulder 23' of the upper support portion 17' as shown in FIG. 2A, thus defining at the junction of the frustoconical portion 18' and the upper support portion 17' a neck 22' having no length.

Figure 3:
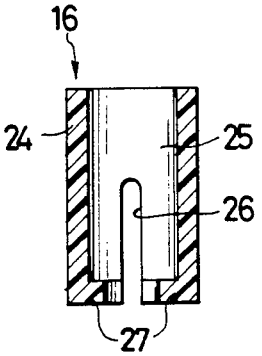
FIG. 3 is a vertical cross-sectional view of a presser.

As shown in FIG. 3, the button holder 16 is of a unitary tubular construction formed integrally of suitably resilient synthetic resin. The button holder 16 has a cylindrical wall 24 defining an axial through hole 25 in the button holder 16. The cylindrical wall 24 has a plurality of circumferentially spaced slots 26 (only one shown in FIG. 3) each extending axially from a substantially central area of the cylindrical wall 24 down to the lower end thereof where the slot 26 opens downwardly. The lower end of the cylindrical wall 24 has a plurality of lips 27 projecting radially inwardly and divided by the slots 26, the lips 27 constricting the hole 25 at the lower end of the button holder 16. As shown in FIG. 1, the button holder 16 is fitted over the lower die 15 with the lips 27 being normally held in engagement with the neck 22. Therefore, the button holder 16 is prevented from being removed upwardly off the upper support portion 17 since the lips 27 engage the shoulder 23. Alternatively, the slot 26 may have in its free form a very small width with virtually no opening.

Figure 5:
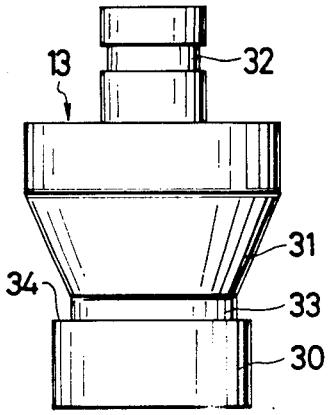
FIG. 5 is a front elevational view of an upper die.
Figure 7:
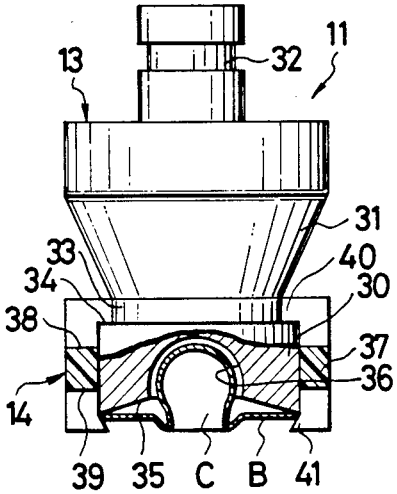
FIG. 7 is an upper button holder/die assembly composed of the upper die and the holder.

As shown in FIGS. 5 and 7, the upper die 13 is of a generally cylindrical shape including a lower presser or button support 30, a central frustoconical portion 31 disposed above the lower presser 30 and having an outer circumferential surface tapered downwardly or progressively spreading radially outwardly in the upward direction, and an upper attachment portion 32 disposed above the central frustoconical portion 31 for attachment to a plunger (not shown) or the like. The upper die 13 also has a neck 33 defined between the lower presser 30 and the central frustoconical portion 31. The neck 33 smoothly blends into the lower end of the central frustoconical portion 31, and is adjoined by a radial shoulder 34 on the upper end of the lower presser 30.

As shown in FIG. 7, the lower presser 30 has a button pressing surface 35 on its lower end and a central recess 36 opening downwardly at the button pressing surface 35. The central recess 36 is shaped complementarily to the central knob C of a button member B.

Figure 6:
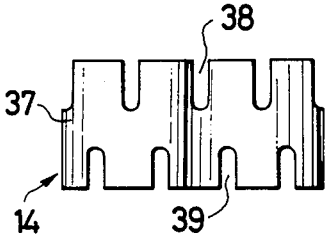
FIG. 6 is a front elevational view of a holder.

As shown in FIG. 6, the button holder 14 is of a unitary tubular structure made of resilient synthetic resin. The button holder 14 includes a cylindrical wall 37 having a plurality of circumferentially spaced upper slots 38 defined in the upper edge portion thereof and opening upwardly and a plurality of circumferentially spaced lower slots 39 defined in the lower edge portion and opening downwardly. The cylindrical wall 37 is of such an inside diameter than it can snugly fit over the lower presser 30 of the upper die 13. As illustrated in FIG. 7, the upper end of the cylindrical wall 37 has a plurality of lips 40 divided by the upper slots 38 and extending radially inwardly. The lower end of the cylindrical wall 37 has a plurality of retainers 41 defined between the lower slots 38 and projecting radially inwardly. The upper slots 38 and the lower slots 39 are staggered with respect to each other in the circumferetial direction of the cylindrical wall 37.

The button holder 14 is fitted over the lower presser 30 with the lips 40 normally engaging the neck 33. Therefore, the button holder 14 is prevented by the lips 40 and the neck 33 from being removed downwardly off the presser 30. With the button holder 14 mounted on the presser 30, the retainers 41 project radially inwardly beyond the lower edge of the outer circumferential surface of the presser 30, as shown in FIG. 7.

For attaching a snap button on a sheet member S such as a fabric piece, the button member B is held in the button holder 14 by the retainers 41 with the knob C positioned in the recess 36, as shown in FIG. 7. The pronged button member A is placed on the upper end of the button holder 16, as shown in FIG. 1. The sheet member S lies between the upper button holder/die assembly 11 and the lower button holder/die assembly 12.

Figure 4:
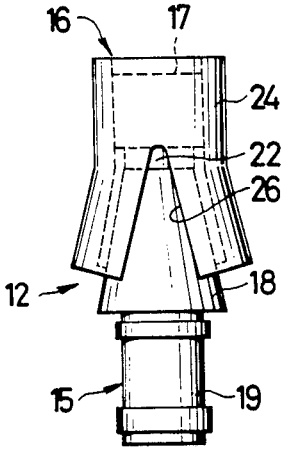
FIG. 4 is a front elevational view of a lower button holder/die assembly composed of the lower die and the presser, the presser being shown as being lowered and elastically deformed.

The upper button holder/die assembly 11 is lowered toward the lower button holder/die assembly 12. As the upper and lower button holder/die assemblies 11, 12 are brought together, the button holder 14 is displaced upwardly with respect to the upper die 13 upon engagement with the button holder 16 through the sheet member S. The lips 40 are spread apart radially outwardly against their resiliency as they slide up the tapered wall of the frustoconical portion 31. At the same time, the retainers 41 are also spread apart radially outwardly onto the circumferential surface of the presser 30, thus releasing the button member B. Such radial elastic displacement of the lips 40, 41 is facilitated by the slots 38, 39 defined in the cylindrical wall 37 of the button holder 14. Simultaneously, the button holder 16 of the lower button holder/die assembly 12 is displaced downwardly with respect to the lower die 15 by the downwardly moving upper button holder/die assembly 11. The lips 27 of the button holder 16 are spread radially outwardly against their resiliency while they are sliding down the tapered wall of the frustoconical portion 18, as shown in FIG. 4. When the button holder 16 is lowered until the pronged button member A is engaged by the upper button support 17 of the lower die 16, the downward movement of the button holder 16 relative to the lower die 15 is arrested. Continued descent of the upper button holder/die assembly 11 causes the prongs of the pronged button member A to pierce the sheet member S and then be clinched about the button member B held against the button pressing surface 35 of the presser 30. The button members A, B are now coupled together into the desired button which is firmly attached to the sheet member S. Since the retainers 41 have now been lifted clear of the button pressing surface 35, the button member B can securely be attached to the sheet member S in intimate contact therewith.

After the button has been attached to the sheet member S, the upper button holder/die assembly 11 is lifted away from the lower button holder/die assembly 12. Since the displacing forces are removed, the holder 14 is moved downwardly with respect to the upper die 13 because the lips 40 are resiliently forced to slide down the frustoconical portion 31 due to the radially inward resiliency of the upper edge portion of the holder 14 where the slots 38 are defined. The holder 14 is lowered until the lips 40 are seated on the neck 33, whereupon the retainers 41 snap back radially inwardly beneath the button pressing surface 35. A new button member can now be held in the holder 14.

At the time the upper holder/die assembly 11 is raised, the holder 16 of the lower holder/die assembly 12 is also allowed to move upwardly with respect to the lower die 15 since the lips 27 are caused to slide up the tapered wall of the frustoconical portion 18 under the resilient forces imposed radially inwardly by the lower portion of the holder 16. The holder 16 is therefore automatically moved upwardly to the position shown in FIG. 1.

The numbers and positions of the slots 26, 38, 39 may be selected to make the holder 16 and the holder 14 uniformly resilient to a suitable extent such that the holder 16 and the holder 14 will automatically be restored properly to their initial positions as quickly as desired.

The upper and lower holder/die assemblies 11, 12 are quite simple in structure as described. Therefore, they can be constructed in small size and assembled with ease, so that they can be employed to attach smaller buttons such as snap buttons, hook buttons, ornamental buttons, and other buttons to sheet materials.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button holder/die assembly in a device for attaching a button to a sheet member, comprising:

(a) a die having a button support, a frustroconical portion tapered toward said button support, and a neck disposed at the junction of said button support and said frustroconical portion; and (b) a tubular button holder of a resilient material moveably fitted over said button support and normally terminating short of said frustroconical portion for holding a button member, said tubular button holder having a cylindrical wall uniform in outside diameter along its entire length, said cylindrical wall having means on one end thereof for supporting the button member and on the opposite end a plurality of radially inwardly extending lips normally engaging said neck, said tubular button holder having a plurality of circumferentially spaced slots each extending from said opposite end away from said frustroconical portion.

2. A button holder/die assembly according to claim 1, said circumferentially spaced slots extending axially to an opening at said opposite end of the cylindrical wall, said lips being divided by said slots.

3. A button holder/die assembly according to claim 1, said resilient material being synthetic resin.

4. A button holder/die assembly according to claim 1, said cylindrical wall having a plurality of circumferentially spaced slots extending axially to and opening at said one end of the cylindrical wall, said means comprising a plurality of retainers divided by said slots and extending radially inwardly beyond a circumferential edge of said button support for holding the button member on said button support.

5. A button holder/die assembly in a device for attaching a button to a sheet member, comprising:

a die having a button support, a frustroconical portion tapered toward said button support, and a neck disposed at the junction of said button support and said frustroconical portion; and a tubular button holder of a resilient material movably fitted over said die for holding a button member, said tubular button holder having a cylindrical wall having means on one end thereof for supporting the button member and on the opposite end a plurality of radially inwardly extending lips normally engaging said neck, said cylindrical wall having a plurality of circumferentially spaced slots extending axially to and opening at said one end of the cylindrical wall, said means comprising a plurality of retainers divided by said slots and extending radially inwardly beyond a circumferential edge of said button support for holding the button member on said button support;

said cylindrical wall having a plurality of circumferentially spaced second slots extending axially to and opening at said opposite end of the cylindrical wall, said lips being divided by said second slots, said first and second slots being staggered with respect to each other in the circumferential direction of said cylindrical wall.

* * * * *